US008896517B2

(12) United States Patent
Liu et al.

(10) Patent No.: US 8,896,517 B2
(45) Date of Patent: Nov. 25, 2014

(54) INTEGRATED BACKLIGHT DRIVING CHIP AND LED BACKLIGHT DEVICE

(75) Inventors: Chia-Chun Liu, Hsinchu County (TW); Chung-Wen Wu, Yilan County (TW); Chien-Cheng Tu, Hsinchu (TW); Sih-Ting Wang, Kaohsiung (TW)

(73) Assignee: NOVATEK Microelectronics Corp., Hsinchu Science Park, Hsin-Chu (TW)

( * ) Notice: Subject to any disclaimer, the term of this patent is extended or adjusted under 35 U.S.C. 154(b) by 152 days.

(21) Appl. No.: 13/118,567

(22) Filed: May 30, 2011

(65) Prior Publication Data

US 2012/0075356 A1 Mar. 29, 2012

(30) Foreign Application Priority Data

Sep. 23, 2010 (TW) ..... 99132178 A

(51) Int. Cl.
*G09G 3/34* (2006.01)

(52) U.S. Cl.
CPC ..... *G09G 3/3406* (2013.01); *G09G 2330/12* (2013.01)
USPC ..... 345/102

(58) Field of Classification Search
None
See application file for complete search history.

(56) References Cited

U.S. PATENT DOCUMENTS

| | | | | |
|---|---|---|---|---|
| 8,144,111 | B2 * | 3/2012 | Kim et al. | 345/102 |
| 2007/0159750 | A1 * | 7/2007 | Peker et al. | 361/93.1 |
| 2009/0295775 | A1 | 12/2009 | Kim et al. | |

FOREIGN PATENT DOCUMENTS

| | | | |
|---|---|---|---|
| CN | 101207953 | A | 6/2008 |
| CN | 201114910 | Y | 9/2008 |
| CN | 201403234 | Y | 2/2010 |
| TW | 200632862 | | 9/2006 |

* cited by examiner

*Primary Examiner* — Joseph Haley
(74) *Attorney, Agent, or Firm* — Winston Hsu; Scott Margo

(57) ABSTRACT

An integrated backlight driving chip for driving a light-emitting diode backlight module includes a scaler circuit and a backlight driving circuit. The scaler circuit includes a digital control unit for generating a digital control signal, and a variable reference voltage generation unit for generating a reference voltage. The backlight driving circuit is coupled to the digital control unit, the variable reference voltage generation unit, and the LED backlight module, for generating a backlight driving signal according to the digital control signal and the reference voltage so as to drive the LED backlight module.

11 Claims, 2 Drawing Sheets

INTEGRATED BACKLIGHT DRIVING CHIP AND LED BACKLIGHT DEVICE

BACKGROUND OF THE INVENTION

1. Field of the Invention

The present invention relates to an integrated backlight driving chip and related LED backlight device, and more particularly, to an integrated backlight driving chip in which a scaler having digital control capability is integrated, and a related LED backlight device.

2. Description of the Prior Art

A liquid crystal display (LCD) offers the advantages of thin construction, low power consumption, and low radiation, so that the LCD is widely applied in various electronic products, such as LCD televisions, computer systems, mobile phones, and personal digital assistants. The LCD operates by varying voltage drops between opposite sides of a liquid crystal layer for twisting liquid crystal molecules in the liquid crystal layer to alter transmittance of the liquid crystal layer, which can be controlled to produce images with the aid of light provided by a backlight module. A typical LCD device includes an LCD panel and a control chipset, a driving chipset, and a backlight module. The control chipset is responsible for transforming and processing image data. The driving chipset is utilized for outputting corresponding voltage signals to control the transmittance of each pixel on the LCD panel for displaying image data. In general, the control chipset usually includes a scaler chip for performing expansion or reduction process on the image data to generate the image data conforming to a required output standard, such as a required resolution or aspect ratio of vertical and horizontal lines.

Since liquid crystal does not emit light itself, the LCD device is usually equipped with a backlight module for providing required light sources to display the image data. Most traditional backlight modules use cold cathode fluorescent lamps (CCFLs) for light sources. In recent years, light emitting diodes (LEDs) used as light sources have become popular because of energy saving, long device lifetime, no mercury used, high achievable color gamut, no idle time, and fast response speed. Furthermore, as the luminous efficiency increases and the cost decreases, LEDs have gradually replaced CCFLs to be the light source in a backlight module.

Please refer to FIG. 1, which is a schematic diagram of an LED backlight device 10 according to the prior art. The LED backlight device 10 includes a backlight module 102, a backlight driving chip 104, and a backlight driving circuit board 106. As shown in FIG. 1, the backlight module 102 includes LED chains C1 to Cm arranged in parallel, where each LED chain includes at least one LED in series. The backlight driving chip 104 is disposed on the backlight driving circuit board 106 for driving the backlight module 102 and controlling the brightness of the LEDs. In general, for various application requirements, the backlight driving chip 104 is able to control current passing through each LED chain or switch frequency by using an external resistor R. However, the external resistor R cannot supply a wide range of capacitance values; therefore, different types of resistors are required for various application situations. In other words, the backlight driving chip 104 needs to operate incoordination with the external resistor R with various resistance values for various application requirements, resulting in high costs. In addition, a corresponding backlight driving chip 104 is required according to the backlight module 102 of different configurations, such as having various numbers of LEDs or various arrangements of the LED chain. Therefore, the conventional backlight driving chip cannot meet all requirements of current or switching frequency due to the existing limitations and is unable to provide flexible usage, causing inconvenience.

Regarding fault detection of the LED backlight device 10, operating power may be cut off when an over-voltage situation or an over-current situation occurs so that the LED backlight module 102 and the backlight driving chip 104 will stop operation accordingly for fault protection. Subsequently, the operating power may be turned on again for follow-up backlight driving operation. However, the fault situation is not able to be recorded meaning the fault situation may be difficult to resolve.

SUMMARY OF THE INVENTION

It is therefore an objective of the present invention to provide an integrated backlight driving chip and related LED backlight device.

The present invention discloses an integrated backlight driving chip for driving a light-emitting diode (LED) backlight module. The integrated backlight driving chip includes a scaler circuit and a backlight driving circuit. The scaler circuit includes a digital control unit for generating a digital control signal and a variable reference voltage generation unit for generating a reference voltage. The backlight driving circuit is coupled to the digital control unit, the variable reference voltage generation unit, and the LED backlight module for generating a backlight driving signal according to the digital control signal and the reference voltage so as to drive the LED backlight module.

The present invention further discloses a light-emitting diode (LED) backlight device. The backlight device includes an LED backlight module and an integrated backlight driving chip. The integrated backlight driving chip includes a scaler circuit and a backlight driving circuit. The scaler circuit includes a digital control unit for generating a digital control signal and a variable reference voltage generation unit for generating a reference voltage. The backlight driving circuit is coupled to the digital control unit, the variable reference voltage generation unit, and the LED backlight module for generating a backlight driving signal according to the digital control signal and the reference voltage so as to drive the LED backlight module.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
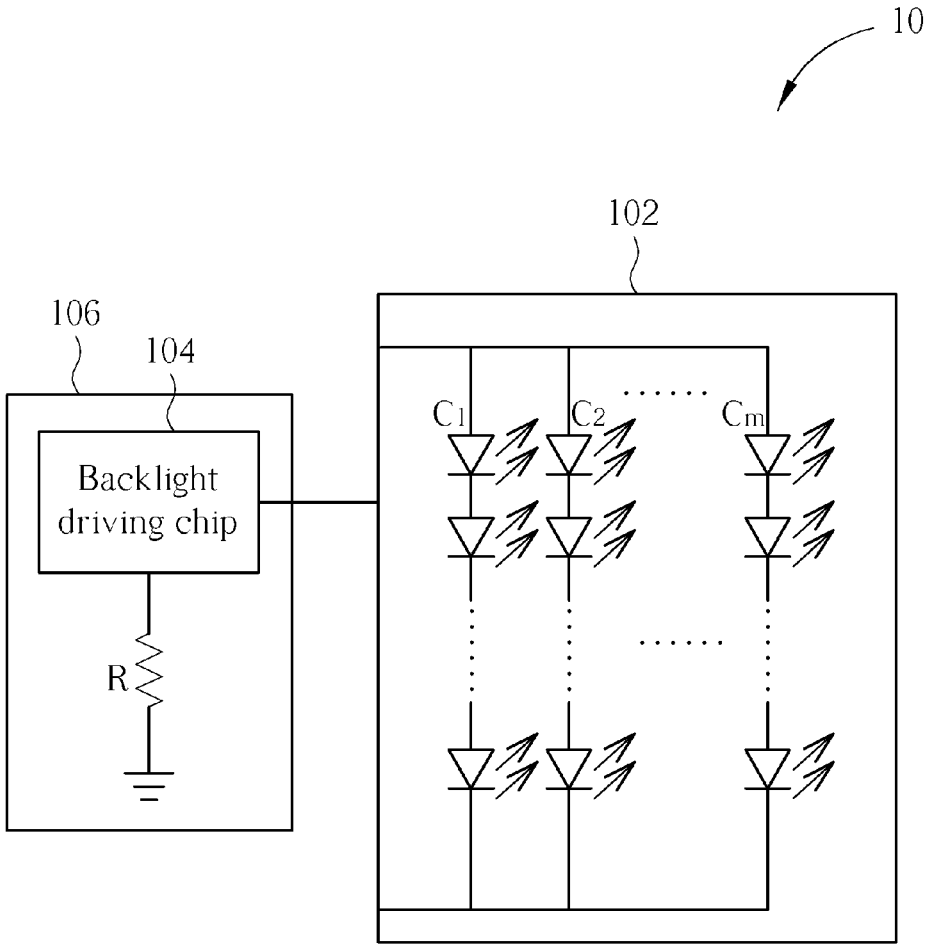
FIG. 1 PRIOR ART
FIG. 1 is a schematic diagram of an LED backlight device according to the prior art.
Figure 2:
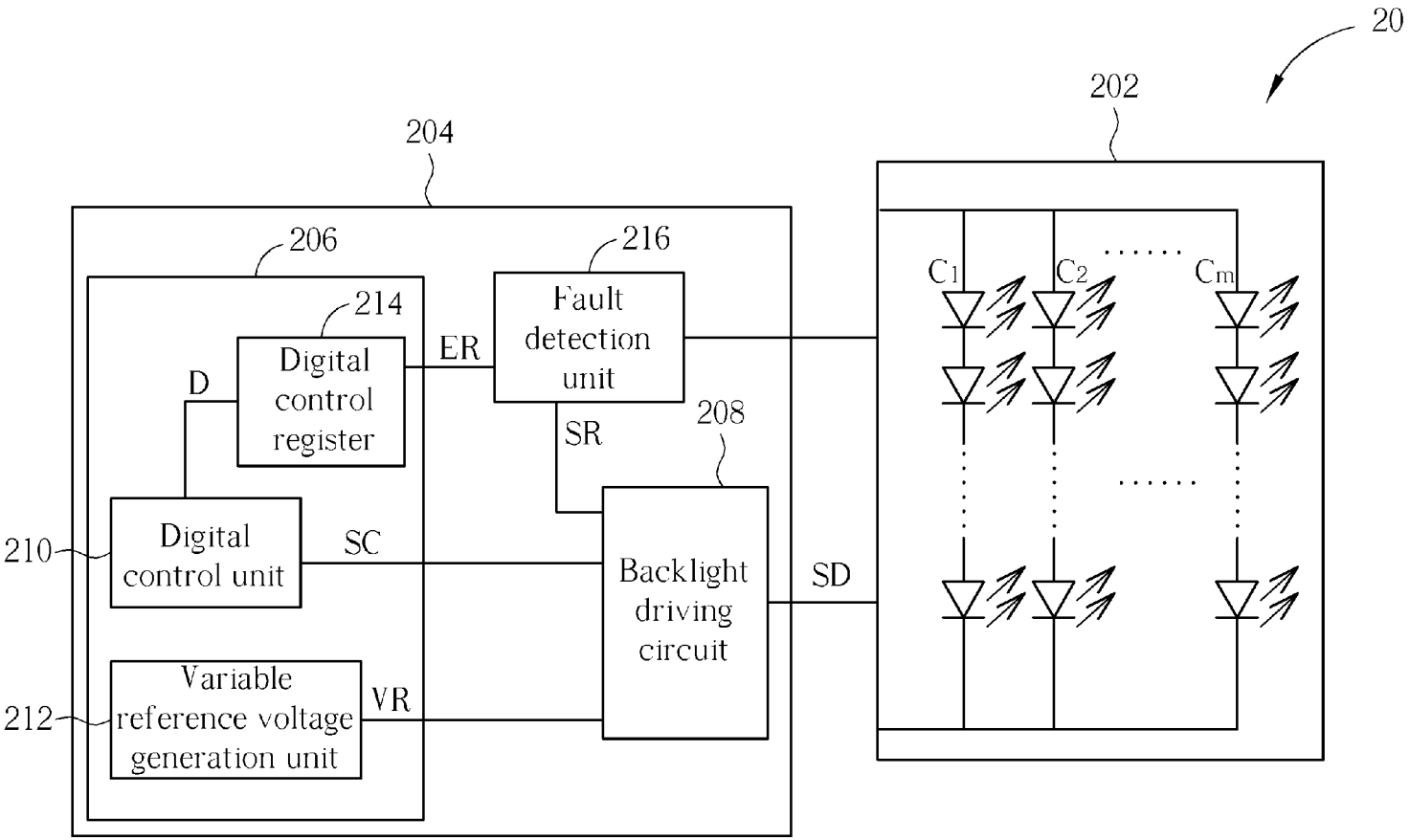
FIG. 2 is a schematic diagram of a light emitting diode backlight device according to an embodiment of the invention.

Please refer to FIG. 2, which is a schematic diagram of alight emitting diode (LED) backlight device 20 according to an embodiment of the invention. The LED backlight device 20 includes an LED backlight module 202 and an integrated driving chip 204. In the embodiment, the LED backlight module 202 includes LED chains C1 to Cm arranged in parallel, where each LED chain includes a plurality of LEDs in series, but this should not be a limitation of the present invention. In other words, the LED backlight module 202 can also have one LED chain only, and each LED chain can include a single LED. The integrated driving chip 204 is utilized for driving the LED backlight module 202 for display.

The integrated driving chip 204 includes a scaler circuit 206 and a backlight driving circuit 208. The scaler circuit 206 includes a digital control unit 210, a variable reference voltage generation unit 212, and a digital control register 214. The digital control register 214 is utilized for storing a backlight driving configuration value D. The digital control unit 210 is coupled to the digital control register 214 for generating a digital control signal SC to the backlight driving circuit 208 according to the backlight driving configuration value D. For example, the digital control signal SC can be transmitted to the backlight driving circuit 208 via a control bus. The variable reference voltage generation unit 212 is coupled to the backlight driving circuit 208 for generating a reference voltage VR. The backlight driving circuit 208 is coupled to the digital control unit 210, the variable reference voltage generation unit 212, and the LED backlight module 202 for generating a backlight driving signal SD according to the digital control signal SC and the reference voltage VR so as to drive the LED backlight module 202. In other words, through the digital control operation of the scaler circuit 206, the LED backlight device 20 is capable of adjusting a backlight driving signal SD outputted by the backlight driving circuit 208 without using external resistors, providing a more flexible and accurate backlight driving operation.

Furthermore, according to various application requirements, such as under different backlight driving configurations or driving different types of LED backlight module, the invention is able to utilize a software configuration method to set the required backlight driving configuration value D in the digital control register 214 so that the digital control unit 210 generates the digital control signal SC accordingly. Moreover, the backlight driving circuit 208 can generate the backlight driving signal SD according to the digital control signal SC and the reference voltage VR to drive the LED backlight module 202. As a result, for different application situations, a user can just modify the configuration value stored in the digital control register 214 so as to provide the required backlight driving signal SD.

Therefore, through integrating the scaler circuit 206 originally designed in a control chip with the backlight driving circuit 208 of a backlight device, the backlight driving circuit 208 can utilize the excellent digital control function of the scaler circuit 206 to provide more driving selections and more accurate signal quality so as to achieve a more flexible backlight driving application.

In a general LCD device, a control chip of a LCD panel often includes a scaler circuit for pixel signal processing. The scaler circuit is usually manufactured on a scaler chip and disposed on a single printed circuit board for an expansion or reduction process of image data. Also, in a conventional LED back light device, a backlight driving circuit is manufactured on a backlight driving chip and disposed on a single printed circuit board for backlight driving. In the embodiment, the scaler circuit 206 and the backlight driving circuit 208 are integrated in the same chip. In such a situation, the scaler circuit 206 not only can offer an image signal transformation function, but can also utilize the excellent digital control capability of the scaler circuit 206 to realize more accurate backlight driving. In addition, the connection between the scaler circuit 206 and the backlight driving circuit 208 can be achieved by simply using on-chip interconnect design without complicated printed circuit board layouts. Compared with the prior art, the invention need not use extra passive components on the printed circuit board, and the integrated driving chip can be achieved through utilizing a single printed circuit board, effectively reducing the manufacturing costs.

The integrated driving chip 204 further includes a fault detection unit 216 coupled to the LED backlight module 202, the backlight driving circuit 208, and the digital control register 214 for detecting the occurrence of operating faults of the LED backlight module 202. When the fault detection unit 216 detects an operating fault (for example, an over-voltage situation or short circuit) that occurs in the LED backlight module 202, the fault detection unit 216 generates a fault result ER and a fault detection signal SR. The fault result ER can be stored in the digital control register 214 for fault detection or rescue. The fault detection signal SR can be transmitted to the backlight driving circuit 208 for related exception handling. In such a condition, since the fault result ER is stored in the digital control register 214, the corresponding operating fault situation occurring in the LED backlight module 202 can be easily examined from the digital control register 214. In other words, the invention is capable of utilizing register function of the scaler circuit 206 to record all operating fault situations for the following exception handling.

In summary, the invention is capable of adjusting the required backlight driving signal outputted by the backlight driving circuit without using external resistors for providing a more flexible and accurate backlight driving operation. In other words, the invention can enhance a more flexible backlight driving application by using programmable operations. In addition, the invention need not use extra passive components on the printed circuit board, and the integrated driving chip including image scaling and backlight driving function can be achieved by merely utilizing a single printed circuit board, reducing manufacturing costs effectively. Moreover, the invention can utilize the register function of the scaler circuit to record all operating fault situations that occur in the LED backlight module for the following exception handling, greatly reducing the difficulties of resolving faults.

Those skilled in the art will readily observe that numerous modifications and alterations of the device and method may be made while retaining the teachings of the invention.

What is claimed is:

1. An integrated backlight driving chip for driving a light-emitting diode (LED) backlight module, comprising:

a scaler circuit, for performing an expansion or reduction process of image data, comprising:

a digital control unit for generating a digital control signal;

a variable reference voltage generation unit for generating a reference voltage; and a digital control register coupled to the digital control unit for storing a backlight driving configuration value so that the digital control unit generates the digital control signal accordingly;

a backlight driving circuit coupled to the digital control unit, the variable reference voltage generation unit, and the LED backlight module, for generating a backlight driving signal according to the digital control signal and the reference voltage so as to drive the LED backlight module; and a fault detection unit coupled to the LED backlight module, the backlight driving circuit, and the digital control register for detecting the occurrence of operating faults of the LED backlight module;

wherein the scaler circuit and the backlight driving circuit are disposed on and integrated in the integrated backlight driving chip, and when the fault detection unit detects an operating fault occurring in the LED backlight module, the fault detection unit generates a fault result and the fault result is stored in the digital control register.

2. The integrated backlight driving chip of claim 1, wherein when the fault detection unit detects an operating fault occurring in the LED backlight module, the fault detection unit generates a fault detection signal to the backlight driving circuit.

3. The integrated backlight driving chip of claim 1, wherein the digital control signal is transmitted to the backlight driving circuit via a control bus.

4. A light-emitting diode (LED) backlight device, comprising:

an LED backlight module; and an integrated backlight driving chip, comprising:

a scaler circuit, for performing an expansion or reduction process of image data comprising:

a digital control unit for generating a digital control signal;

a variable reference voltage generation unit for generating a reference voltage; and a digital control register coupled to the digital control unit for storing a backlight driving configuration value so that the digital control unit generates the digital control signal accordingly;

a backlight driving circuit coupled to the digital control unit, the variable reference voltage generation unit, and the LED backlight module, for generating a backlight driving signal according to the digital control signal and the reference voltage so as to drive the LED backlight module; and a fault detection unit coupled to the LED backlight module, the backlight driving circuit, and the digital control register for detecting the occurrence of operating faults of the LED backlight module;

wherein the scaler circuit and the backlight driving circuit are disposed on and integrated in the integrated backlight driving chip, and when the fault detection unit detects an operating fault occurring in the LED backlight module, the fault detection unit generates a fault result and the fault result is stored in the digital control register.

5. The LED backlight device of claim 4, wherein the LED backlight module comprises a plurality of LED chains arranged in parallel.

6. The LED backlight device of claim 4, wherein when the fault detection unit detects an operating fault occurring in the LED backlight module, the fault detection unit generates a fault detection signal to the backlight driving circuit.

7. The LED backlight device of claim 4, wherein the digital control signal is transmitted to the backlight driving circuit via a control bus.

8. The integrated backlight driving chip of claim 1, wherein the fault result is stored in the digital control register for following fault detection or rescue.

9. The LED backlight device of claim 4, wherein the fault result is stored in the digital control register for following fault detection or rescue.

10. An integrated backlight driving chip for driving a light-emitting diode (LED) backlight module, comprising:

a scaler circuit, for performing an expansion or reduction process of image data, comprising:

a digital control unit for generating a digital control signal;

a variable reference voltage generation unit for generating a reference voltage; and a digital control register coupled to the digital control unit for storing a backlight driving configuration value so that the digital control unit generates the digital control signal accordingly; and a backlight driving circuit coupled to the digital control unit, the variable reference voltage generation unit, and the LED backlight module, for generating a backlight driving signal according to the digital control signal and the reference voltage so as to drive the LED backlight module;

wherein the scaler circuit and the backlight driving circuit are disposed on and integrated in the integrated backlight driving chip.

11. A light-emitting diode (LED) backlight device, comprising:

an LED backlight module; and an integrated backlight driving chip, comprising:

a scaler circuit, for performing an expansion or reduction process of image data, comprising:

a digital control unit for generating a digital control signal;

a variable reference voltage generation unit for generating a reference voltage; and a digital control register coupled to the digital control unit for storing a backlight driving configuration value so that the digital control unit generates the digital control signal accordingly; and a backlight driving circuit coupled to the digital control unit, the variable reference voltage generation unit, and the LED backlight module, for generating a backlight driving signal according to the digital control signal and the reference voltage so as to drive the LED backlight module;

wherein the scaler circuit and the backlight driving circuit are disposed on and integrated in the integrated backlight driving chip.

* * * * *